US008599017B2

(12) United States Patent
Clarissou

(10) Patent No.: US 8,599,017 B2
(45) Date of Patent: Dec. 3, 2013

(54) METHOD AND DEVICE FOR MONITORING THE PRESENCE OF A RAIL

(75) Inventor: Yves Clarissou, Paris (FR)

(73) Assignee: Siemens SAS, St. Denis (FR)

( * ) Notice: Subject to any disclaimer, the term of this patent is extended or adjusted under 35 U.S.C. 154(b) by 254 days.

(21) Appl. No.: 13/255,952

(22) PCT Filed: Mar. 31, 2009

(86) PCT No.: PCT/EP2009/053772

§ 371 (c)(1),
(2), (4) Date: Sep. 20, 2011

(87) PCT Pub. No.: WO2010/102676

PCT Pub. Date: Sep. 16, 2010

(65) Prior Publication Data

US 2012/0006946 A1 Jan. 12, 2012

(30) Foreign Application Priority Data

Mar. 12, 2009 (EP) ..... 09290179

(51) Int. Cl.
*G08B 21/00* (2006.01)

(52) U.S. Cl.
USPC ..... 340/540

(58) Field of Classification Search
USPC ..... 340/540, 933, 435, 901; 246/120, 170
See application file for complete search history.

(56) References Cited

U.S. PATENT DOCUMENTS

| | | | | | |
|---|---|---|---|---|---|
| 3,929,308 | A * | 12/1975 | Armstrong et al. | ..... | 246/169 A |
| 4,696,446 | A * | 9/1987 | Mochizuki et al. | ..... | 246/169 S |
| 5,803,411 | A * | 9/1998 | Ackerman et al. | ..... | 246/169 R |
| 7,937,192 | B2 * | 5/2011 | Lueger et al. | ..... | 701/19 |
| 2002/0139903 | A1 * | 10/2002 | Nico et al. | ..... | 246/170 |

FOREIGN PATENT DOCUMENTS

| | | | |
|---|---|---|---|
| AU | 500063 | B2 | 5/1979 |
| DE | 19827271 | A1 | 12/1999 |
| DE | 19919604 | A1 | 11/2000 |
| EP | 1422119 | A1 | 5/2004 |
| JP | 7079501 | A | 3/1995 |

* cited by examiner

*Primary Examiner* — Phung Nguyen
(74) *Attorney, Agent, or Firm* — Laurence A. Greenberg; Werner H. Stemer; Ralph E. Locher

(57) ABSTRACT

A method and a device for monitoring the presence of at least one guide rail for a guided vehicle, include a first detector located downstream of a wheel. The detector is capable of detecting the presence of the rail and of transmitting a first signal relating to the presence of the rail to a monitoring member. A second detector located upstream of the wheel can be connected in parallel to the first detector and is capable of detecting the presence of the rail. The second detector can communicate a second signal, relating to the presence of the rail, to the monitoring member.

12 Claims, 1 Drawing Sheet

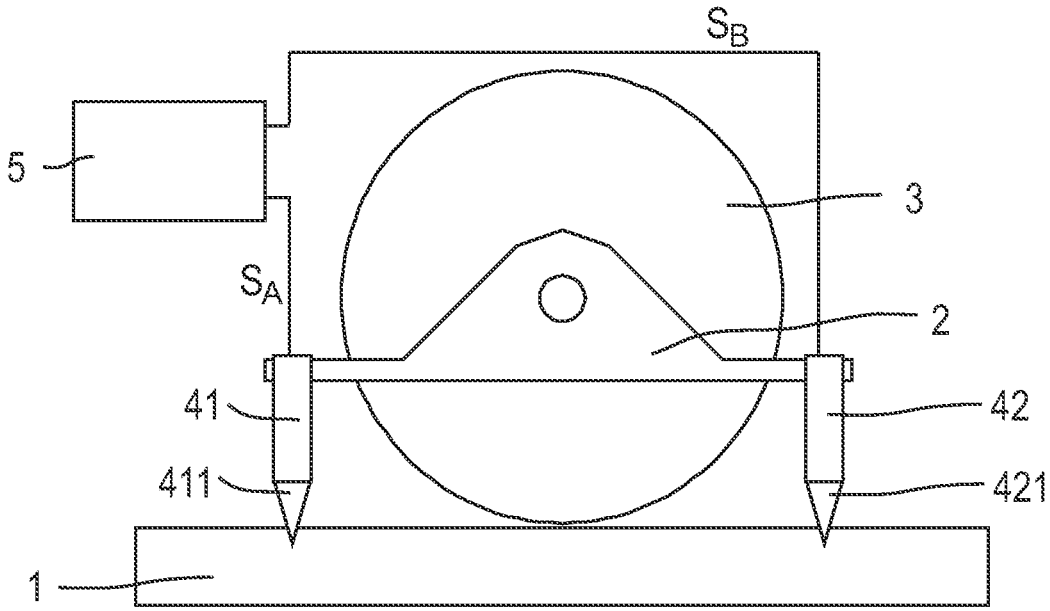
$S_B$
5
3
$S_A$
2
41
42
411
421
1

METHOD AND DEVICE FOR MONITORING THE PRESENCE OF A RAIL

BACKGROUND OF THE INVENTION

Field of the Ivention

The present invention relates to a method and a device for monitoring in real time the correct interfacing relationship between a wheel and its rail, which include detecting the presence of the rail with a first detector located downstream of the wheel, and transmitting a signal relating to the presence of the rail from the first detector to a monitoring member.

The invention relates in particular to the detection and monitoring of the presence of a rail serving to guide guided vehicles.

The term "guided vehicles" refers in particular to public mass transit means such as buses, trolleybuses, streetcars, subways, trains or train units, etc., wherein the safety aspect is very important and wherein the guidance is ensured by means of at least one rail. Although said systems have operated until now without the detection of wheel/rail interaction or derailment, recent and future safety regulations require an additional safety device associated with wheel/rail interfacing. Said rail is used in particular to guide said wheel during its displacement by rotation along said rail, said wheel being able to be a guide wheel, for example.

The document FR 2909061 A1 (or WO2008074942 A1) discloses a device for detecting the risk of derailment and removal of debris or objects on the rail guideway for a vehicle. The detection of the derailment is based on the loss of electrical contact between a shoe and the rail, said loss of contact thus triggering emergency braking. Said shoe is uniquely adapted to a geometric rail shape in order to guarantee the best possible electrical contact therewith. On the other hand said shoe is exposed to a harsh external environment which may, under certain conditions, adversely affect the reliability of the detection, in particular in the event of loss of electrical contact in spite of correct wheel/rail interfacing. However, the present invention does not relate to a detection model adapted to a unique geometric shape of rail but makes it possible to overcome the errors associated with detection by electrical contact, in particular problems associated with the electrical contact itself, while achieving further advantages.

BRIEF SUMMARY OF THE INVENTION

An object of the present invention is to propose a method and a simple device, which is safe and reliable, for ensuring the reliability of the guidance of guided vehicles, in an ideal manner, and which is easily adaptable to any type of rail-guided vehicle, irrespective of the geometry of the rail.

A further object of the invention is to develop a solution for the detection and monitoring of the presence of a rail which is efficient in a harsh external environment.

By "harsh external environment", reference is made to exposure to dust, to dirt, to vibrations and to climatic variations, such as for example variations in temperature (−33° C. to 50° C.) or moisture, the formation of ice, etc. Said method and said device may be described as safe if they permit a derailment or incorrect wheel/rail interfacing to be detected with certainty, and as reliable if they permit faulty detection to be avoided, i.e. a detection of derailment even though the wheel/rail relationship is correct.

Toward that end, a device and a method are proposed by the invention.

Proceeding from a method for monitoring the presence of at least one guide rail for a guided vehicle, associated in particular with ensuring the wheel/rail interfacing of said guided vehicle, and comprising:

- a first detection of the presence of said rail by means of a first detector located downstream of a wheel, said wheel being able to be, in particular, a guide wheel,
- a transmission, by said first detector, of a first signal relating to said presence of said rail to a monitoring member, the method according to the invention is characterized by

- at least one second detector located upstream of said wheel, or in particular of said guide wheel, being arranged in parallel with said first detector,
- a second detection of the presence of said rail by means of said second detector,
- said second detector communicating to said monitoring member a second signal relating to said presence of said rail.

In order to avoid any ambiguity, "upstream" and "downstream" respectively refer by definition to the direction from which a displacement comes and to the direction of a future displacement in a reference system associated with the rail. A downstream position of a detector means that said detector precedes said wheel during its displacement, and an upstream position means that said detector follows said wheel, i.e. is located after said wheel relative to its displacement. Thus, an upstream detector and a downstream detector encompass a wheel on both sides, along a longitudinal axis of the rail.

Moreover, the monitoring method according to the invention is characterized by an implementation of said detection in real time, without contact with said rail, whether it be said first or said second detection. In particular, not only the detection but also a signaling of the presence or absence of a rail by said detectors to the monitoring member is implemented in real time such that the monitoring member monitors and ascertains the wheel/rail interfacing state in real time. Advantageously, the real-time monitoring of the wheel-on-rail relationship improves the reliability of the guidance of a guided vehicle.

Moreover, the monitoring method according to the invention is characterized in particular by mounting of the first detector on a first support downstream of the wheel and of the second detector on a second support upstream of said wheel, said supports being fixed, for example, to an arm carrying said wheel or, in particular, a roller bearing arm.

On the other hand the monitoring method according to the invention is characterized in particular by an indication or validation by the monitoring member of a current rail state, i.e. of a correct wheel/rail interfacing state, if at least one of said first and second signals indicates the presence of the rail. In particular, the monitoring member monitors the wheel/rail interfacing of at least one wheel positioned on at least one of the ends of the guided vehicle. As long as at least one of the two signals respectively originating from the two detectors associated with the same wheel signals the presence of the rail, the wheel/rail interfacing state is considered correct by the monitoring member and it is thus capable of validating the current rail state. In contrast, as soon as the two signals respectively originating from the two detectors associated with the same wheel indicate the absence of a rail, the monitoring member is capable of signaling a derailment. In particular, the consequences of signaling the derailment by the monitoring member are, for example, emergency braking of the guided vehicle resulting in an emergency stop of said vehicle, the transmission, for example by the monitoring member, of a warning signal or an alarm to a monitoring station, and an inspection at the location of the emergency braking of the causes and consequences of said braking by the operating personnel.

Similarly, each of said detections, i.e. the first and the second detection, is based on the use of at least one logical operator during the monitoring of the presence of said rail by said monitoring member. For example, said detectors, located on both sides of the same wheel, are arranged in parallel in order to implement a logical "OR" which permits the monitoring member to consider a wheel/rail interfacing state correct if one or other of the detectors detects the presence of the rail and signals it to the monitoring member. Advantageously, the parallel arrangement of the detectors according to a logical "OR" makes it possible to overcome numerous problems, such as for example:

- any kind of gap in the rail, such as fish plate joints, expansion joints, insulating joints, gaps in the points: in this case, when one of the detectors signals the absence of a rail, the other detector, not yet located at the level of said gap, signals the presence of said rail, which makes it possible for the monitoring member to validate correct wheel/rail interfacing,
- the effects of the position of the guided vehicle relative to the rail such as a variation in the seating of an arm carrying said wheel (for example a roller bearing arm or axle box) in addition to the combined effects of the profile of the track and/or the dynamics of the vehicle: in this case, the movement of a detector away from the rail, a displacement which could potentially cause an alarm or emergency braking, is compensated by the other detector moving commensurately closer, such that there is always at least one of said detectors which detects the presence of the rail,
- a failure of a detector: in the event of failure of one of the detectors the other detector is always capable of signaling the presence of the rail and in addition the monitoring member is capable of signaling a malfunction of the detector indicating a continuous absence of rail.

Furthermore, the parallel arrangement of said detectors thus permits numerous improvements. For example, this consists in filtering false alarms on one of said detectors, improving tolerance to variations in the seating of the roller bearing arm on which said detectors are mounted or even improving the reliability of the detection of the presence of rail where rail joints in non-metallic insulating material are present.

On the other hand, the monitoring method according to the invention is characterized in particular in that at least one of said detections is effected by means of a proximity detector in order to be a detection of proximity. Advantageously, and in a non-exhaustive manner, said detection of proximity is based on a capacitive or inductive effect or a combination of a capacitive effect and an inductive effect in order to detect, for example, the proximity of metal corresponding to the presence of the rail. Advantageously, said detection of proximity, without contact with the rail and based in particular on a capacitive and/or inductive effect in order to detect the rail, not only makes it possible to avoid the problems associated with accumulation of dust but also permits a monitoring of the presence of the rail in environments which are particularly harsh for the operation of said guided vehicle and all the components thereof.

Finally, the connection in series by cable of a logical information system for the presence or absence of rail, originating either from the monitoring member or directly from said detectors, to an obstacle detection device which is generally also present at the ends of the guided vehicle, makes it possible in particular to combine the detection of obstacles with the device for monitoring the presence of the rail.

Based on a device for monitoring the presence of at least one guide rail of a guided vehicle, associated with ensuring a correct wheel/rail interfacing of guided vehicles and comprising:

- a first detector located downstream of a wheel, said wheel being, in particular, a guide wheel and said detector being capable of detecting the presence of said rail and transmitting a first signal relating to said presence of said rail to a monitoring member, the device according to the invention is characterized in that

- a second detector located upstream of said wheel or, in particular, of said guide wheel, is capable of being connected in parallel with said first detector and detecting said presence of said rail (1),
- said second detector is capable of communicating to said monitoring member a second signal relating to said presence of said rail.

In particular, the device according to the invention is characterized in that said detectors are capable of performing a detection in real time and without contact with said rail. In particular, the detectors are capable not only of detecting in real time the presence of said rail, but also of signaling in real time to the monitoring member the presence or absence of said rail, such that the monitoring member is capable of monitoring and ascertaining in real time the correct state of wheel/rail interfacing, i.e. the presence or absence of a rail.

Moreover, the device according to the invention is characterized in that said monitoring member is capable of validating a correct wheel/rail interfacing state, i.e. validating a current rail state, by using at least one logical operation. In particular, the monitoring member is capable of confirming/validating the presence of the rail by using a logical "OR", i.e. if at least one of said first and second signals detects and indicates the presence of the rail. Advantageously, operating the monitoring of the presence of said rail by means of a logical operator such as the logical "OR" function makes it possible to filter false alarms on one of said detectors, yet also to improve the tolerance of the detection of variations in the seating of a roller bearing arm relative to the rail such that when one of the sensors moves away from the rail and signals an absence of a rail, the other detector commensurately approaches said rail and signals the presence of a rail. Since in this case one of the detectors signals the presence of a rail, the logical "OR" operation permits the monitoring member to deduce the presence of said rail and thus to confirm or validate a correct wheel/rail interfacing state. Similarly, the use of a logical operator such as "OR" improves the tolerance of the detection of the rail joints, in particular joints made of non-metallic insulating material. More specifically, given that during the passage of the wheel over a non-metallic joint, the first detector, passing above said non-metallic joint, will signal the absence of a rail, while at the same time the second detector, sufficiently remote from the first detector to be opposite the rail and not the joint, will signal the presence of the rail. Thus, since at least the second detector signals the presence of a rail, the monitoring member will deduce a correct wheel/rail interfacing state and, for example, will not alert any monitoring station.

In particular, the device according to the invention is characterized in that at least one of said detectors is a proximity detector, such as for example a proximity detector for metal. In particular, the device according to the invention is characterized in that said detectors detect the presence of the rail by means of a capacitive proximity detection or detection by induction. In a general manner the proximity detection is not limited to a detection based on a capacitive or inductive effect but may also, for example, be based on a combination of these effects. Advantageously, a detection without contact with the rail, in particular by means of capacitive or inductive detectors, makes it possible to avoid the problems associated with accumulation of dirt. Moreover, the proximity detectors are capable of operating in particularly harsh environments.

Moreover, the device according to the invention is characterized in particular by a first and a second detector support fixed to an arm carrying said wheel, upstream and downstream respectively of said wheel and to which are fixed respectively the first and second detectors. In particular, said arm is a roller bearing arm. Advantageously, the positioning of the detectors upstream and downstream of said wheel, above or in particular in the vicinity of said rail, makes it possible when said detectors are arranged in parallel to improve the reliability of the detection of the presence of a rail.

Finally, an exemplary embodiment is provided by means of a drawing.

BRIEF DESCRIPTION OF THE SEVERAL VIEWS OF THE DRAWING

The figure shows an exemplary embodiment of the device for monitoring the presence of a rail.

DESCRIPTION OF THE INVENTION

By way of example, the figure shows a device for monitoring the presence of at least one guide rail (1) for a guided vehicle, associated with ensuring the reliability of the wheel/rail interfacing of said guided vehicle, comprising:

- a first detector (41) located downstream of a wheel or, in particular, a guide wheel (3), i.e. preceding the wheel or the guide wheel in a direction of displacement of said wheel or said guide wheel, said detector (41) being capable of detecting the presence of said rail (1) and transmitting a first signal ($S_A$) relating to said presence of said rail to a monitoring member (5), characterized in that

- a second detector (42) located upstream of said wheel or said guide wheel (3), i.e. following said guide wheel or said wheel in the direction of displacement of said wheel or guide wheel, is capable of being connected in parallel with said first detector (41) and of detecting the presence of said rail (1),
- said second detector (42) is capable of communicating to said monitoring member (5) a second signal ($S_B$) relating to said presence of said rail (1).

In particular, for each wheel where it is desired to monitor the wheel/rail interfacing thereof, a detection system may be put in place comprising at least two proximity detectors for metal (41, 42) connected to at least one monitoring member (5) to which signals ($S_A$, $S_B$) relating to the presence of said rail are transmitted. In particular, said two detectors are identical and have the same characteristics for detection of the rail. Advantageously, a single monitoring member (5) is capable of monitoring the wheel/rail interfacing of a plurality of wheels, in particular wheels located at the ends of said guided vehicle, in order to guarantee at least the correct wheel/rail interfacing of the ends of a guided vehicle. In this case the detectors associated with a plurality of wheels each transmit to the same monitoring member a signal relating to the presence of said rail. The monitoring member is then capable of processing the information relating to the presence of said rail, said information being conveyed from said signals transmitted by each of said detectors.

The detectors (41, 42) may advantageously be fixed to an axle box or an equivalent member fixed to an external cage of the bearings of the wheel, such as a roller bearing arm (2) for example, as close as possible to the contact zone between the wheel and the rail so that at least one part of said rail is included in a detection cone (411, 421) of said detector (41, 42). Said detection cone corresponds to a spatial area in which the detector is capable of detecting the presence of the rail.

Moreover, and in particular, the detectors arranged in parallel provide binary information by dry contact, for example closed when the rail is present opposite the detector and open when the rail is absent opposite the detector. Also, the "resting" contact of each detector, not used for detecting the presence of a rail, may be used to detect potential failures of the detector, without waiting for the failure to be manifested by an alarm. By "resting" contact, reference is made to the contact state of an electromechanical device when it is not supplied with power, said state being able to be either open or closed, depending on the case. On the other hand, learning detectors may be used, such as for example a detector with a metal environment memory, in the case where the permanent proximity to other metallic pieces, such as for example a wheel, would generate the detection.

On the other hand and in an advantageous manner, the monitoring member is capable of being connected in series by cable to an obstacle detection device, which is generally present at the ends of a guided vehicle, in order to combine said rail presence monitoring device with said obstacle detection device.

In summary, the method and the device according to the invention provide several advantages compared to existing methods and devices, in that:

- they provide detection of the presence of the rail irrespective of nominal gaps in the rail,
- they provide a detection of the presence of the rail, irrespective of the geometry of the rail,
- they improve the detection of said rail in the event of variations in the seating of the arm carrying said wheel relative to the rail,
- they permit false alarms to be filtered on a sensor,
- they permit a detection of the presence of the rail in harsh environmental conditions of detection, in particular in the case of exposure to dust, to extreme temperatures and to high levels of humidity.

The invention claimed is:

1. A method for monitoring a presence of at least one guide rail for a guided vehicle, the method comprising the following steps:

- providing a first detector disposed downstream of a wheel;
- carrying out a first detection of the presence of the rail with the first detector;
- transmitting a first signal relating to the presence of the rail from the first detector to a monitoring member;
- providing at least one second detector disposed upstream of the wheel and connected in parallel with the first detector;
- carrying out a second detection of the presence of the rail with the at least one second detector; and
- communicating a second signal relating to the presence of the rail from the at least one second detector to the monitoring member.

2. The monitoring method according to claim 1, which further comprises carrying out the first and second detections in real time without contacting the rail.

3. The monitoring method according to claim 1, which further comprises validating a correct wheel/rail interfacing state with the monitoring member if at least one of the signals indicates the presence of the rail.

4. The monitoring method according to claim 1, which further comprises carrying out at least one of the detections with a proximity detector.

5. The monitoring method according to claim 1, which further comprises mounting the first detector on a first support downstream of the wheel, mounting the second detector on a second support upstream of the wheel, and fixing the supports to an arm carrying the wheel.

6. A device for monitoring a presence of at least one guide rail for a guided vehicle, the device comprising:

a monitoring member;

a first detector disposed downstream of a wheel, said first detector configured for detecting the presence of the rail and configured for transmitting a first signal relating to the presence of the rail to said monitoring member; and a second detector disposed upstream of the wheel, said second detector configured to be connected in parallel with said first detector and configured for detecting the presence of the rail;

said second detector configured for communicating a second signal, relating to the presence of the rail, to said monitoring member.

7. The monitoring device according to claim 6, wherein said detectors are configured for carrying out a detection in real time and without contacting said rail.

8. The monitoring device according to claim 6, wherein said monitoring member is configured for validating a correct wheel/rail interfacing state by using at least one logical operation.

9. The monitoring device according to claim 6, wherein at least one of said detectors is a proximity detector.

10. The monitoring device according to claim 6, which further comprises:

an arm carrying the wheel; and first and second detector supports fixed to said arm and respectively disposed upstream and downstream of the wheel;

said first and second detectors being respectively fixed to said first and second detector supports.

11. The monitoring device according to claim 6, wherein said detectors detect the presence of the rail through a capacitive detection/detection by induction.

12. The monitoring device according to claim 6, wherein said detectors detect the presence of the rail by capacitive detection.

* * * * *